US008624785B2

(12) United States Patent
Chen

(10) Patent No.: US 8,624,785 B2
(45) Date of Patent: Jan. 7, 2014

(54) DUAL-BAND ANTENNA

(75) Inventor: Hsi-Chieh Chen, Tu-Cheng (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 299 days.

(21) Appl. No.: 13/082,537

(22) Filed: Apr. 8, 2011

(65) Prior Publication Data

US 2012/0001805 A1 Jan. 5, 2012

(30) Foreign Application Priority Data

Jun. 30, 2010 (TW) ..... 99121600 A

(51) Int. Cl.
*H01Q 1/38* (2006.01)

(52) U.S. Cl.
USPC ..... 343/700 MS; 343/702

(58) Field of Classification Search
USPC ..... 343/702, 700 MS
See application file for complete search history.

(56) References Cited

U.S. PATENT DOCUMENTS

2007/0035453 A1* 2/2007 Martinez et al. ..... 343/702

* cited by examiner

*Primary Examiner* — Karl D Frech
(74) *Attorney, Agent, or Firm* — Altis Law Group, Inc.

(57) ABSTRACT

A dual-band antenna includes a radiator unit. The radiator unit includes a base portion, an extension portion extending from the base portion, a connecting portion extending from the extension portion, a transition portion extending from the connecting portion, and a u-shaped portion extending from the transition section. The connecting portion, the extension portion, and the base portion define a first slot. The u-shaped portion defines a second slot.

11 Claims, 3 Drawing Sheets

DUAL-BAND ANTENNA

BACKGROUND

1. Technical Field

The present disclosure relates to antennas, and particularly to a dual-band antenna for portable electronic devices.

2. Description of Related Art

Many portable electronic devices, such as mobile phones, personal digital assistants, and laptop computers use two antennas to enable dual band operation of the devices. Obviously, two antennas occupy a lot of space within the devices.

Therefore, there is room for improvement within the art.

BRIEF DESCRIPTION OF THE DRAWINGS

Many aspects of the present dual-band antenna can be better understood with reference to the following drawings. The components in the various drawings are not necessarily drawn to scale, the emphasis instead being placed upon clearly illustrating the principles of the present dual-band antenna. Moreover, in the drawings, like reference numerals designate corresponding parts throughout the figures.

DETAILED DESCRIPTION

Figure 1:
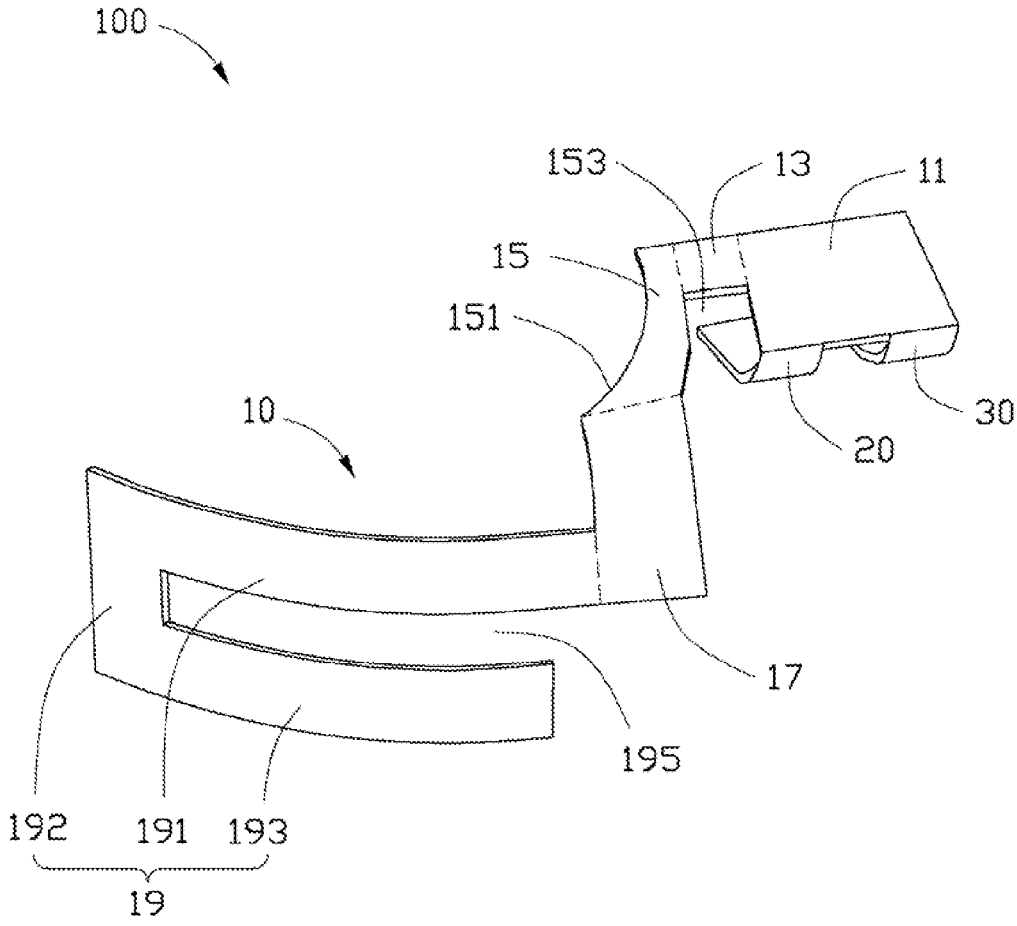
FIG. 1 is a schematic view of a dual-band antenna, according to an exemplary embodiment.
Figure 2:
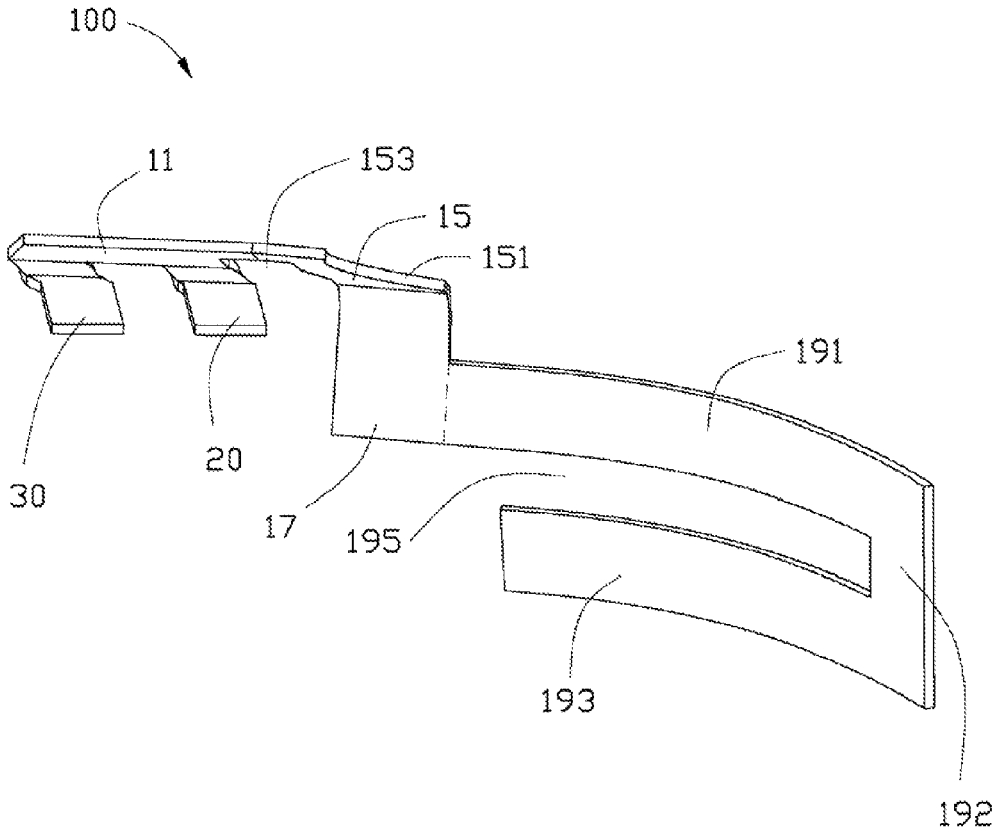
FIG. 2 is similar to FIG. 1, but viewed from another angle.

FIG. 1 and FIG. 2 schematically show a dual-band antenna 100, according to an exemplary embodiment. The dual-band antenna 100 includes a radiator unit 10, a feed unit 20, and a ground unit 30. The dual-band antenna 100 can be used in a portable electronic device such as a mobile phone, a personal digital assistant, or a laptop computer. The dual-band antenna 100 can be one unitary component and made of flexible printed circuit.

The radiator unit 10 includes a base portion 11, an extension portion 13, a connecting portion 15, a transition portion 17, and a u-shaped portion 19. Because of the schematic depiction of the drawings and the potential unitary construction, the precise beginnings and ends of various parts of the antenna need not be exactly as depicted in this disclosure. The extension portion 13 and the connecting portion 15 are substantially coplanar with the base portion 11. The transition portion 17 and the u-shaped portion 19 are non-coplanar with the base portion 11.

The base portion 11 and the extension portion 13 have straight perimeter edges. The extension portion 13 extends away from a perimeter edge of the base portion 11.

The connecting portion 15 is a planar sheet. The connecting portion 15 perpendicularly extends from a portion of the extension portion 13, opposite to the base portion 11, and in a plane parallel to the plane of the base portion 11. One portion of the connecting portion 15 can define a curved edge 151 for fitting the antenna around installed components, such as cameras. Perimeter edges of the extension portion 13, the base portion 11 and the connecting portion 15 define a first slot 153. In the exemplary embodiment, the first slot 153 has straight edges, and by varying the size of the first slot 153, the electric length of the dual-band antenna 100 can be tuned to a first particular desired frequency band performance.

The transition portion 17 is a longitudinal planar sheet, and substantially perpendicular with the connecting portion 15. The transition portion 17 extends from where the right angle connects to the connecting portion 15. The u-shaped portion 19 is slightly curved and includes a first section 191, a second section 192, and a third section 193. The first section 191 extends away from the transition portion 17. The second section 192 has one end connected to a distal end of the first section 191 away from the transition portion 17 and another end connected to the third section 193. The first section 191 is longer than the third section 193. The first section 191, the second section 192, and the third section 193 cooperatively form a second slot 195. The second slot 195 has straight edges, and by varying the size of the second slot 195, the electric length of the dual-band antenna 100 can be tuned to a second particular desired frequency band performance.

The feed unit 20 is substantially hook-shaped and extending from the edge of the base portion 11. The feed unit 20 is angled relative to the base portion 11. The feed unit 20 is electronically connected to a feed point of a circuit board of the portable electronic device (not shown).

The ground unit 30 is substantially hook-shaped and extending from the edge of the base portion 11. The ground unit 30 is parallel to the feed unit 20. The ground unit 30 is angled relative to the base portion 11. The ground unit 30 is electronically connected to a ground point of a circuit board of the portable electronic device (not shown).

The dual-band antenna 100 conserves space because it can be installed on a surface of a housing of the portable electronic device.

Resonant frequency of the dual-band antenna 100 ranges from about 2.4 GHz to 2.5 GHz generally corresponding to Bluetooth™ and WIFI™ operating frequency range. Table 1 shows a maximum gain and a radiation efficiency of the dual-band antenna 100 at different frequencies. Clearly the dual-band antenna 100 meets design requirements for antennas.

TABLE 1

| Frequency (MHz) | Gain (dB) | Efficiency (%) |
|---|---|---|
| 2400 | −3.3 | 46.7 |
| 2420 | −2.8 | 51.9 |
| 2480 | −2.6 | 54.5 |
| 2500 | −3.1 | 48.8 |

Figure 3:
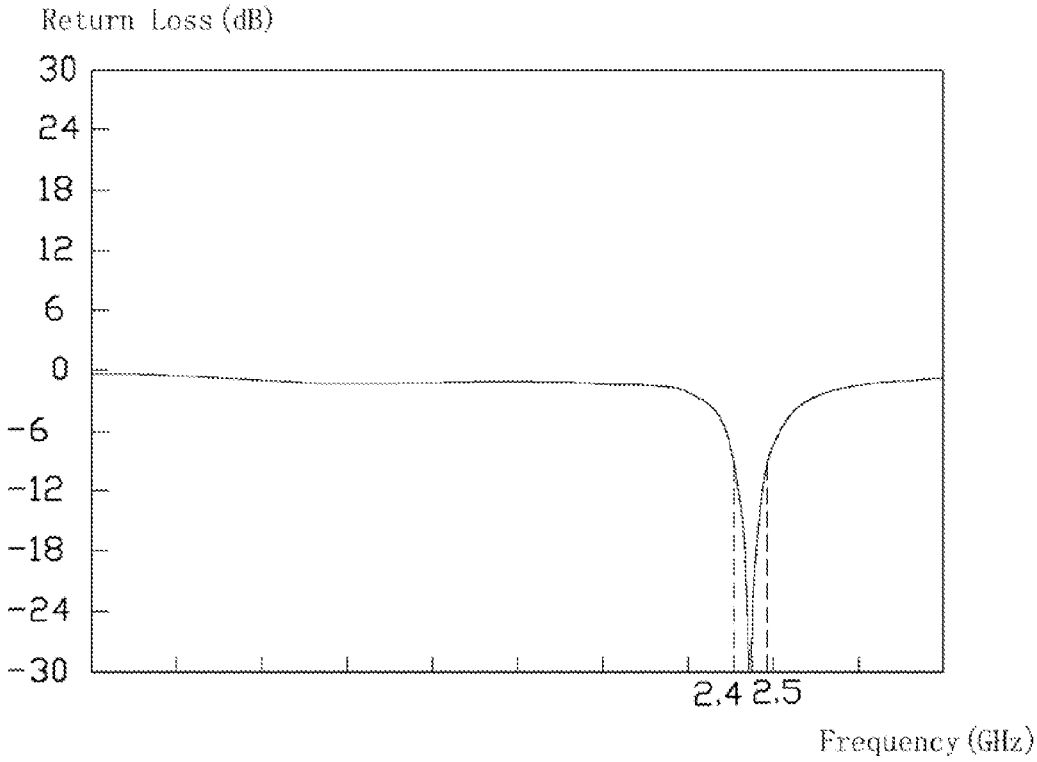
FIG. 3 is a diagram showing return loss measurement of the dual-band antenna shown in FIG. 1.

FIG. 3 is a measurement diagram of return loss (RL) of the dual-band antenna 100. When the dual-band antenna 100 receives/sends wireless signals at frequencies of about 2.4 GHz to about 2.5 GHz, the RL of the dual-band antenna 100 is less than −6 dB, and satisfies communication standards.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A dual-band antenna, comprising:

a radiator unit comprising:

a base portion;

an extension portion extending from the base portion;

a connecting portion extending from the extension portion, wherein the connecting portion, the extension portion and the base portion define a first slot for tuning the antenna to a first frequency band;

a transition portion extending from the connecting portion; and a u-shaped portion comprising a first section, a second section, and a third section, the first section extending from the transition portion, one end of the second section connected to a distal end of the first section away from the transition portion, another end of the second section connected to the third section to form a second slot for tuning the antenna to a second frequency band; wherein the extension portion and the connecting portion are substantially coplanar with the plane of the base portion; the transition portion and the u-shaped portion are non-coplanar with the plane of the base portion.

2. The dual-band antenna as claimed in claim 1, wherein the dual-band antenna works in the frequency band of Bluetooth.

3. The dual-band antenna as claimed in claim 1, wherein the dual-band antenna works in the frequency band of WIFI.

4. The dual-band antenna as claimed in claim 1, further comprising a feed unit extending from the base portion, wherein the feed unit is hook-shaped, and is angled relative to the base portion.

5. The dual-band antenna as claimed in claim 4, further comprising a ground unit extending from the base portion, wherein the ground unit is angled relative to the base portion.

6. The dual-band antenna as claimed in claim 5, wherein the ground unit is hook-shaped and parallel to the feed unit.

7. The dual-band antenna as claimed in claim 1, wherein the dual-band antenna is made of flexible printed circuit.

8. The dual-band antenna as claimed in claim 1, wherein the first section is longer than the third section.

9. The dual-band antenna as claimed in claim 1, wherein the second slot has straight edges.

10. The dual-band antenna as claimed in claim 1, wherein the first slot has straight edges.

11. The dual-band antenna as claimed in claim 1, wherein one portion of the connecting portion defines a curved edge for fitting the antenna around installed components.

* * * * *